US008299990B2

(12) United States Patent
Park et al.

(10) Patent No.: US 8,299,990 B2
(45) Date of Patent: Oct. 30, 2012

(54) FLAT PANEL DISPLAY AND METHOD OF DRIVING THE FLAT PANEL DISPLAY

(75) Inventors: Ok-Kyung Park, Suwon-si (KR); Mi-Hae Kim, Suwon-si (KR); Seon-I Jeong, Suwon-si (KR); Chang-Soo Pyon, Suwon-si (KR); Sam-Il Han, Suwon-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 814 days.

(21) Appl. No.: 12/382,295

(22) Filed: Mar. 12, 2009

(65) Prior Publication Data

US 2009/0251455 A1 Oct. 8, 2009

(30) Foreign Application Priority Data

Apr. 2, 2008 (KR) ..... 10-2008-0030904

(51) Int. Cl.
*G09G 3/34* (2006.01)

(52) U.S. Cl. ..... 345/84; 345/76; 345/82; 345/92; 345/96; 345/214

(58) Field of Classification Search ..... None
See application file for complete search history.

(56) References Cited

U.S. PATENT DOCUMENTS 5,426,447 A * 6/1995 Lee ..... 345/103
6,525,556 B2 * 2/2003 Matsueda ..... 324/750.3
7,038,652 B2 * 5/2006 Kang et al. ..... 345/98
7,193,602 B2 * 3/2007 Morita ..... 345/100
7,468,718 B2 * 12/2008 Shin ..... 345/98
7,557,783 B2 * 7/2009 Kim ..... 345/82
7,728,806 B2 * 6/2010 Shin ..... 345/98
8,049,684 B2 * 11/2011 Kim ..... 345/76

(Continued)

FOREIGN PATENT DOCUMENTS

JP 3659246 3/2005

(Continued)

OTHER PUBLICATIONS

Transmitter letter and Korean Office Action issued on Jun. 22, 2009 in the corresponding Korean Patent Application No. 10-2008-0030904.

(Continued)

*Primary Examiner* — Dismery Mercedes
(74) *Attorney, Agent, or Firm* — Robert E. Bushnell, Esq.

(57) ABSTRACT

A flat panel display sequentially supplying data signals to a pixel portion using a demultiplexer and a method of driving the flat panel sufficiently supply scan signals in a horizontal period to prevent deformation and distortion of the data signal supplied to each pixel and compensate for a threshold voltage of a drive transistor of the pixel. The flat panel display includes a pixel portion having a plurality of pixels, a scan driver to supply scan signals to the pixel portion, a data driver to generate data signals, a demultiplexer portion to sequentially supply the data signals to the pixel portion, and a lighting tester to supply a lighting test signal and an initialization signal to the pixel portion. Alternatively, the flat panel display includes a pixel portion having a plurality of pixels, a scan driver to supply scan signals to the pixel portion, a data driver to output data signals and a demultiplexer portion to sequentially supply an initialization signal and the data signal to the pixel portion.

10 Claims, 9 Drawing Sheets

U.S. PATENT DOCUMENTS

| | | | | |
|---|---|---|---|---|
| 2006/0044236 | A1* | 3/2006 | Kim | 345/82 |
| 2006/0107146 | A1* | 5/2006 | Kim et al. | 714/727 |
| 2006/0125738 | A1 | 6/2006 | Kim et al. | |
| 2006/0151745 | A1* | 7/2006 | Kim et al. | 252/301.16 |
| 2006/0232541 | A1* | 10/2006 | Kudo et al. | 345/98 |
| 2006/0262130 | A1* | 11/2006 | Kim et al. | 345/589 |
| 2006/0267885 | A1* | 11/2006 | Kwak et al. | 345/76 |
| 2006/0274570 | A1* | 12/2006 | Jeoung et al. | 365/154 |
| 2006/0279313 | A1* | 12/2006 | Fujita et al. | 324/765 |
| 2007/0008268 | A1 | 1/2007 | Park et al. | |
| 2007/0057877 | A1* | 3/2007 | Choi et al. | 345/76 |
| 2007/0242016 | A1 | 10/2007 | Choi | |
| 2008/0048946 | A1* | 2/2008 | Kwak | 345/76 |

FOREIGN PATENT DOCUMENTS

| | | | |
|---|---|---|---|
| JP | 2006-301166 | | 11/2006 |
| JP | 2007-286572 | | 11/2007 |
| KR | 10-2005-0003753 | | 1/2005 |
| KR | 10-2005-0068233 | | 7/2005 |
| KR | 10-2006-0027023 | A | 3/2006 |
| KR | 10-2006-0064129 | A | 6/2006 |
| KR | 10-2006-0092666 | A | 8/2006 |
| KR | 10-0624114 | | 9/2006 |
| KR | 10-2006-0135434 | | 12/2006 |
| KR | 10-0666646 | | 1/2007 |
| KR | 10-0688800 | | 2/2007 |
| KR | 10-2007-0032870 | | 3/2007 |
| KR | 10-2007-0081950 | | 8/2007 |
| KR | 10-2007-0103183 | | 10/2007 |
| KR | 10-2008-0067489 | | 7/2008 |

OTHER PUBLICATIONS

Transmitter letter and Korean Office Action issued by Korean Patent Office on Aug. 26, 2009 in the corresponding Korean Patent Application No. 10-2008-0067489.

* cited by examiner

FLAT PANEL DISPLAY AND METHOD OF DRIVING THE FLAT PANEL DISPLAY

CLAIM OF PRIORITY

This application makes reference to, incorporates the same herein, and claims all benefits accruing under 35 U.S.C. §119 from an application for FLAT PANEL DISPLAY DEVICE AND METHOD OF DRIVING THE SAME earlier filed in the Korean Intellectual Property Office on 2 Apr. 2008 and there duly assigned Serial No. 2008-0030904.

BACKGROUND OF THE INVENTION

1. Field of the Invention

The present invention relates to a flat panel display and a method of driving the flat panel display, and more particularly, the present invention relates to a flat panel display sequentially supplying data signals to a pixel portion using a demultiplexer and a method of driving the flat panel display, supplying scan signals in a horizontal period to prevent deformation and distortion of the data signal supplied to each pixel and compensating for a threshold voltage of a drive transistor of the pixel.

2. Description of the Related Art

Since flat panel displays are lightweight and thin, they are used as alternatives to Cathode-Ray Tube (CRT) displays. Examples of flat panel displays include Liquid Crystal Displays (LCDs), and Organic Light Emitting Diode (OLED) displays.

The OLED displays generate excitons by recombination of electrons and holes, which are injected through a cathode and an anode, into an organic thin film, and emit light having a predetermined wavelength due to energy from the excitons. The OLED displays have high brightness and a wide viewing angle, and can be embodied in an ultra slim shape because they do not need a back-light.

In the flat panel display, a plurality of pixels commonly connected to one scan line are connected to different data lines. Therefore, when the number of pixels arranged in directions of scan lines and data lines is increased for a higher resolution, the number of data lines is also increased in proportion to the number of pixels. As a result, the number of data drive circuits included in a data driver to supply data to the respective pixels through the plurality of data lines is increased, and thus the production cost is increased.

To solve these problems, data signals generated by the data driver are sequentially supplied to the plurality of data lines using a Demultiplexer (Demux) which can selectively output an input signal to one of a plurality of output lines, thereby reducing the number of data drive circuits included in the data driver.

However, the flat panel display using the demultiplexer is driven in one horizontal period divided into two durations, i.e., a record duration of data signals and an application duration of scan signals to allow the data signal to be supplied to each pixel, such that deformation of the data signals sequentially input due to the data signals which supplied to pixels during a previous horizontal period can be prevented.

Accordingly, in the flat panel display using the demultiplexer, the application duration of the scan signals during the horizontal period is relatively shorter as the resolution is increased. Thus, when each of the plurality of pixels includes a compensation circuit for preventing the distortion or deformation of the data signal supplied to each pixel and compensating for a threshold voltage of the drive transistor, the circuit cannot sufficiently ensure the application duration of the scan signals which are necessary to compensate for the threshold voltage of the drive transistor.

SUMMARY OF THE INVENTION

Aspects of the present invention provide a flat panel display and a method of driving the flat panel display, which prevents distortion or deformation of a data signal supplied to each pixel, and ensures an application duration of scan signals to compensate for a threshold voltage of a drive transistor by supplying an initialization signal to a data line, not electrically connected to a data driver before or during the application of the scan signal to each pixel in one horizontal period, and to supply a data signal to each pixel during the application of the scan signal.

According to an embodiment of the present invention, a flat panel display includes: a pixel portion having a plurality of pixels; a scan driver to supply a scan signal to the pixel portion; a data driver to generate a data signal; a demultiplexer portion to sequentially supply the data signal to the pixel portion; and a lighting tester to supply a lighting test signal and an initialization signal to the pixel portion.

According to another embodiment of the present invention, a flat panel display includes: a pixel portion having a plurality of pixels; a scan driver to supply a scan signal to the pixel portion; a data driver to output a data signal; and a demultiplexer portion to sequentially supply an initialization signal and the data signal to the pixel portion.

According to still another embodiment of the present invention, a method of driving a flat panel display, including a scan driver, a data driver, a pixel portion having a plurality of pixels and a lighting tester, and sequentially supplying data signals to the pixel portion using a demultiplexer, the method including: supplying an initialization signal to a test interconnection of the lighting tester; electrically connecting the test interconnection to a plurality of data lines electrically connected to the pixel portion in response to a control signal of the lighting tester, and to supply the initialization signal to the pixel portion; supplying a scan signal to the pixel portion; and sequentially supplying a data signal to the pixel portion during the application of the scan signal.

According to yet another embodiment of the present invention, a method of driving a flat panel display, including a scan driver, a data driver and a pixel portion having a plurality of pixels, and sequentially supplying data signals to the pixel portion using a demultiplexer, the method including: dividing one horizontal period into a first period and a second period; dividing a plurality of data lines electrically connecting the plurality of pixels and the demultiplexer to a first group and a second group; supplying initialization signals to the data lines of the first group during the first period; sequentially supplying data signals to the data lines of the second group during the first period; supplying scan signals to the pixel portion during the second period; and sequentially supplying data signals to the data lines of the first group during the second period of supplying the scan signals.

According to yet another embodiment of the present invention, a method of driving a flat panel display including a scan driver, a data driver and a pixel portion having a plurality of pixels, and sequentially supplying data signals to the pixel portion using a demultiplexer, the method including: supplying scan signals during one horizontal period; sequentially electrically connecting data lines to the pixel portion and the data driver in response to control signals; and electrically connecting at least one of the plurality of data lines, not connected to the data driver, to an initialization interconnection supplied with an initialization signal in response to the control signals.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
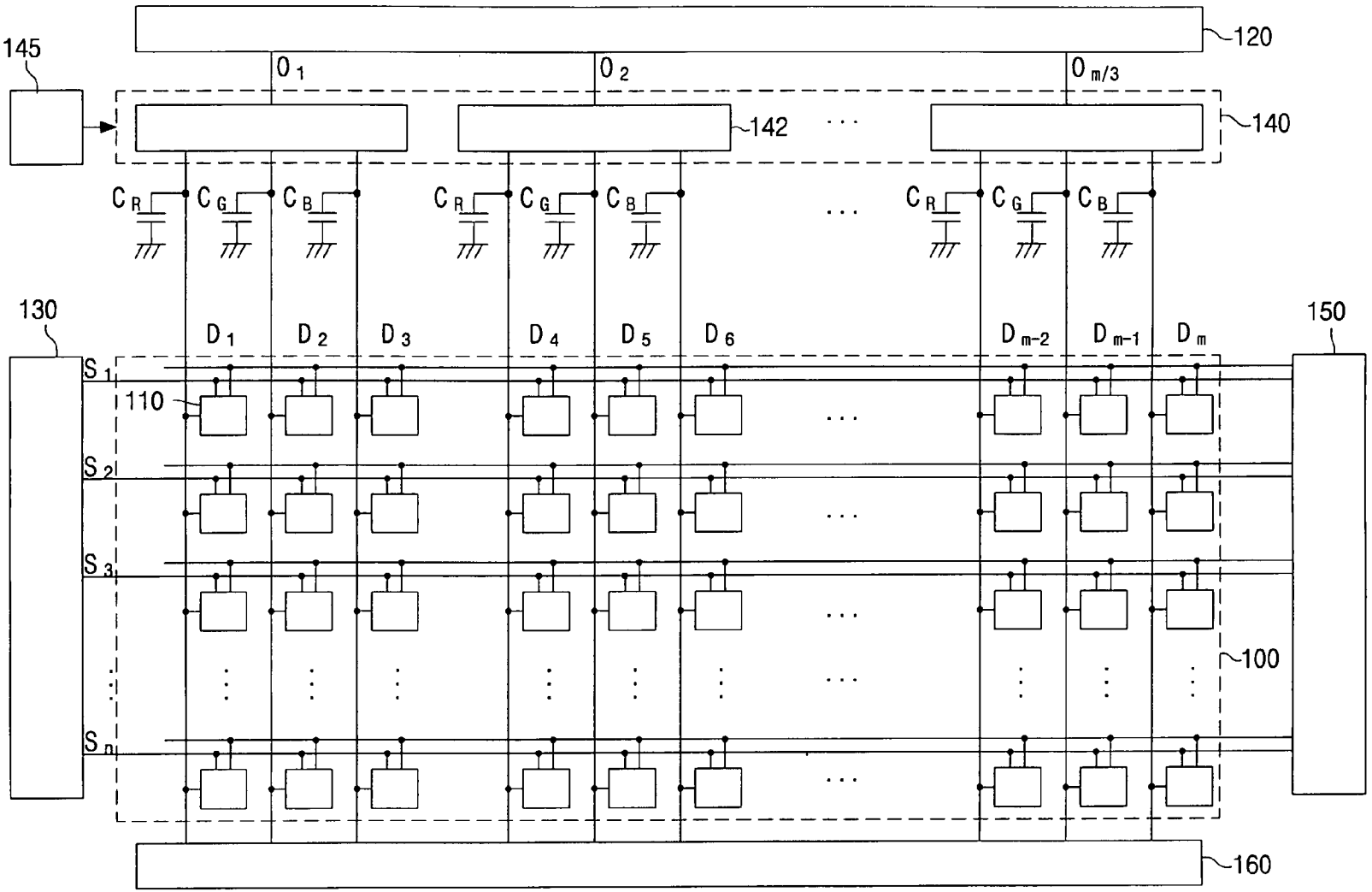
FIG. 1 is a schematic view of a flat panel display according to a first exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
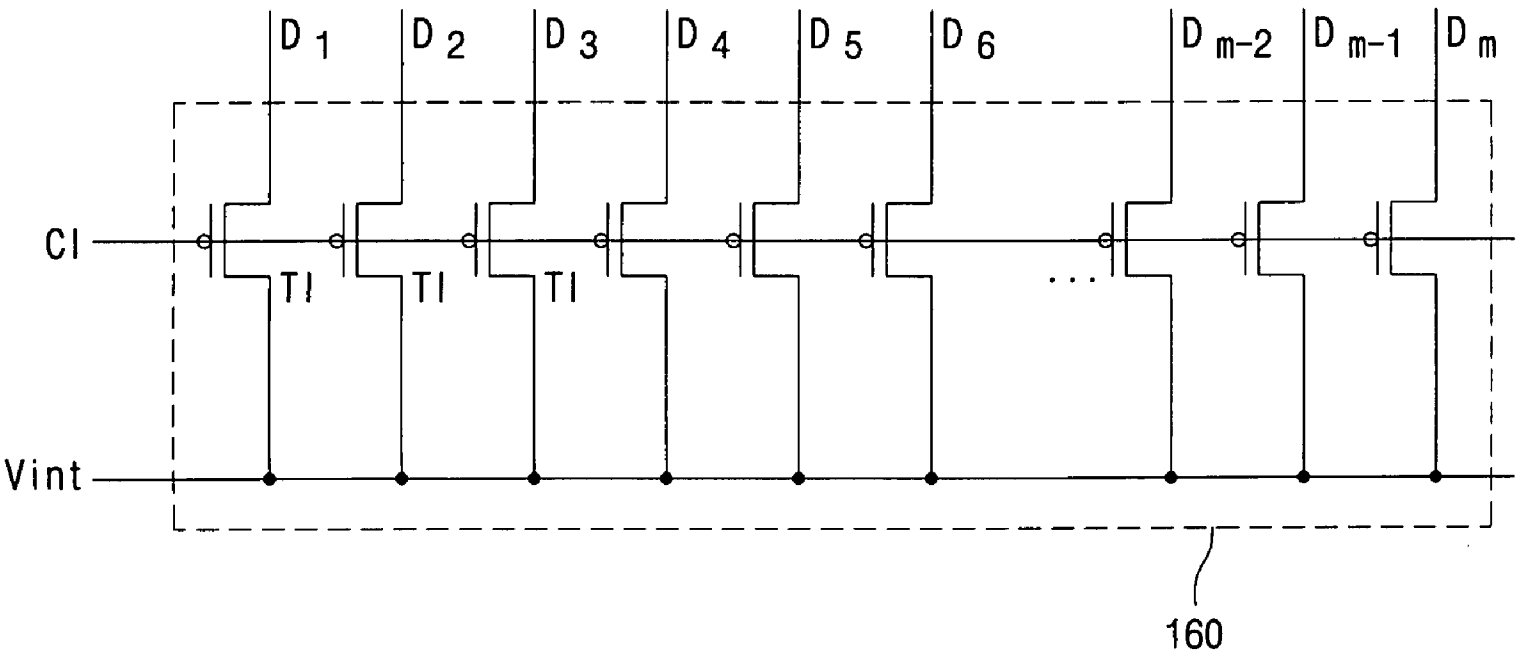
FIG. 2 is a circuit diagram of a lighting tester of the flat panel display according to the first exemplary embodiment of the present invention.

FIG. 1 is a schematic view of a flat panel display according to a first exemplary embodiment of the present invention, and FIG. 2 is a circuit diagram of a lighting tester of the flat panel display according to the first exemplary embodiment of the present invention.

Referring to FIGS. 1 and 2, the flat panel display according to the first exemplary embodiment includes a pixel portion 100 having a plurality of pixels 110, a scan driver 130 for supplying a scan signal to the pixel portion 100, a data driver 120 for outputting data signals to a plurality of output lines $O_1$ to $O_{m/3}$, a demultiplexer portion 140 having at least one demultiplexer 142 for receiving the data signals through the plurality of output lines $O_1$ to $O_{m/3}$ and for sequentially supplying the data signals to the pixel portion 100 through a plurality of data lines $D_1$ to $D_m$, and a lighting tester 160 for supplying a lighting test signal or an initialization signal to the pixel portion 100.

The pixel portion 100 may include a blue pixel for displaying blue colors, a red pixel for displaying red colors and a green pixel for displaying green colors, and may further include a pixel (not illustrated) for displaying colors other than the red, green and blue colors.

The data driver 120 converts a digital image signal received from a timing controller (not illustrated) into a data signal, and supplies the data signal to the demultiplexer portion 140, and the demultiplexer 142 of the demultiplexer portion 140 sequentially supplies the data signal to the pixel portion through the plurality of data lines $D_1$ to $D_m$ electrically connected to the pixel portion 100 in response to a control signal of a demultiplexer controller 145. The plurality of data lines $D_1$ to $D_m$ may further include capacitors $C_R$, $C_G$ and $C_B$ for storing voltages corresponding to data signals of the respective pixels 110.

Figure 3:
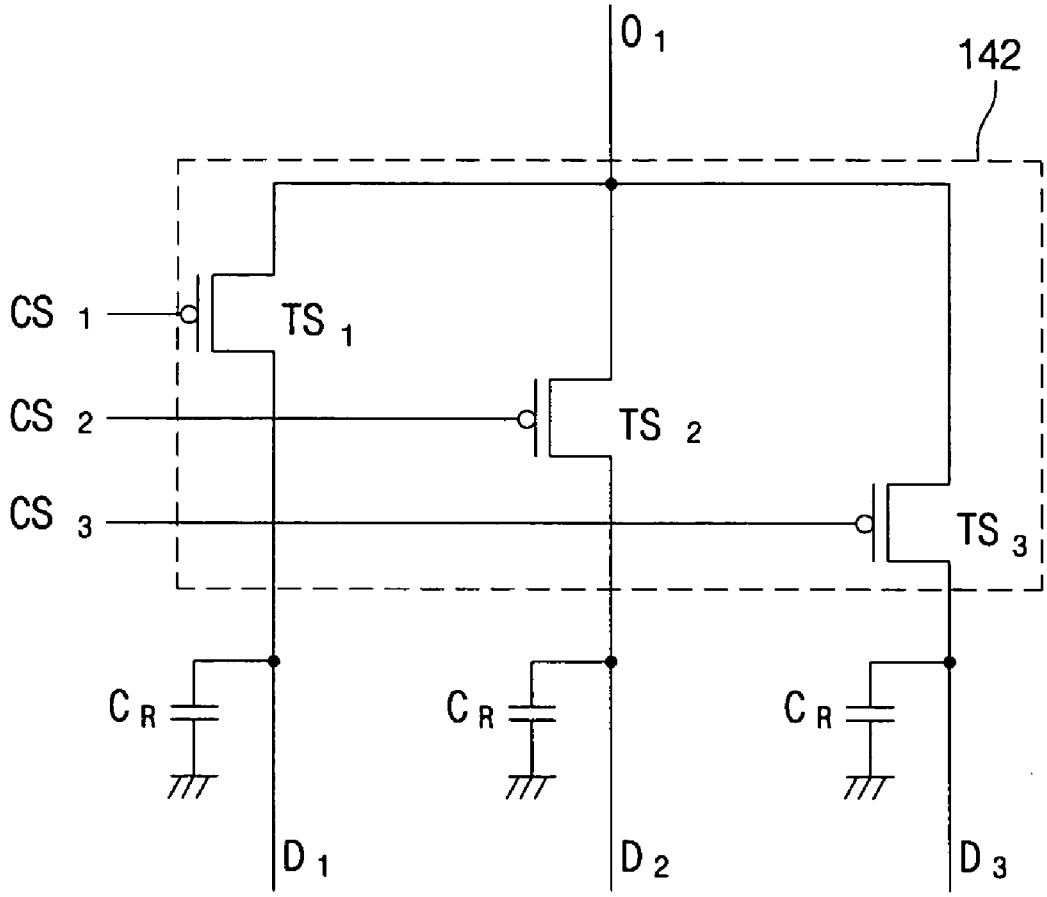
FIG. 3 is a circuit diagram of an example of a demultiplexer of the flat panel display according to the first exemplary embodiment of the present invention.

FIG. 3 is a circuit diagram of the demultiplexer electrically connected to a first output line of the data driver in the demultiplexer portion 140 of the flat panel display according to the first exemplary embodiment of the present invention.

Referring to FIG. 3, the demultiplexer 142 includes first to third data lines $D_1$ to $D_3$ electrically connected to respective pixels 110 of the pixel portion 100, a first switching transistor $TS_1$ disposed between the first data line $D_1$ and the output line $O_1$ of the data driver, a second switching transistor $TS_2$ disposed between the second data line $D_2$ and the output line $O_1$ of the data driver and a third switching transistor $TS_3$ disposed between the third data line $D_3$ and the output line $O_1$ of the data driver. The demultiplexer 142 sequentially controls the first, second and third switching transistors $TS_1$, $TS_2$ and $TS_3$ in response to first to third control signals respectively supplied through first to third control interconnections $CS_1$ to $CS_3$.

The scan driver 130 generates scan signals in response to scan drive control signals supplied from the timing controller, and sequentially supplies the generated scan signals to the plurality of scan lines $S_1$ to $S_n$ electrically connected to the pixel portion 100.

The lightning tester 160 is to supply a lighting test signal to the pixel portion 100 during a lighting test, which uses a test interconnection to which the lighting test signal is supplied as an initialization interconnection $V_{int}$ to which an initialization signal is supplied in the first exemplary embodiment of the present invention.

Furthermore, after the lighting test of the flat panel display according to the first exemplary embodiment of the present invention has been completed, an initialization transistor TI is turned on in response to the initialization signal during normal drive so as to supply the initialization signal to each pixel 110 using a lighting transistor and a lighting control interconnection for controlling the lighting test signal supplied to each pixel during the lighting test as the initialization transistor TI and an initialization control interconnection CI.

The lighting tester 160, as illustrated in FIG. 2, includes a plurality of initialization transistors TI disposed between a plurality of data lines $D_1$ to $D_m$ electrically connected to the plurality of pixels 110 and the initialization interconnection $V_{int}$, and all initialization transistors TI disposed between the plurality of data lines $D_1$ to $D_m$ and the initialization interconnection $V_{int}$ are simultaneously controlled in response to an initialization control signal supplied through the initialization interconnection $V_{int}$.

Figure 5:
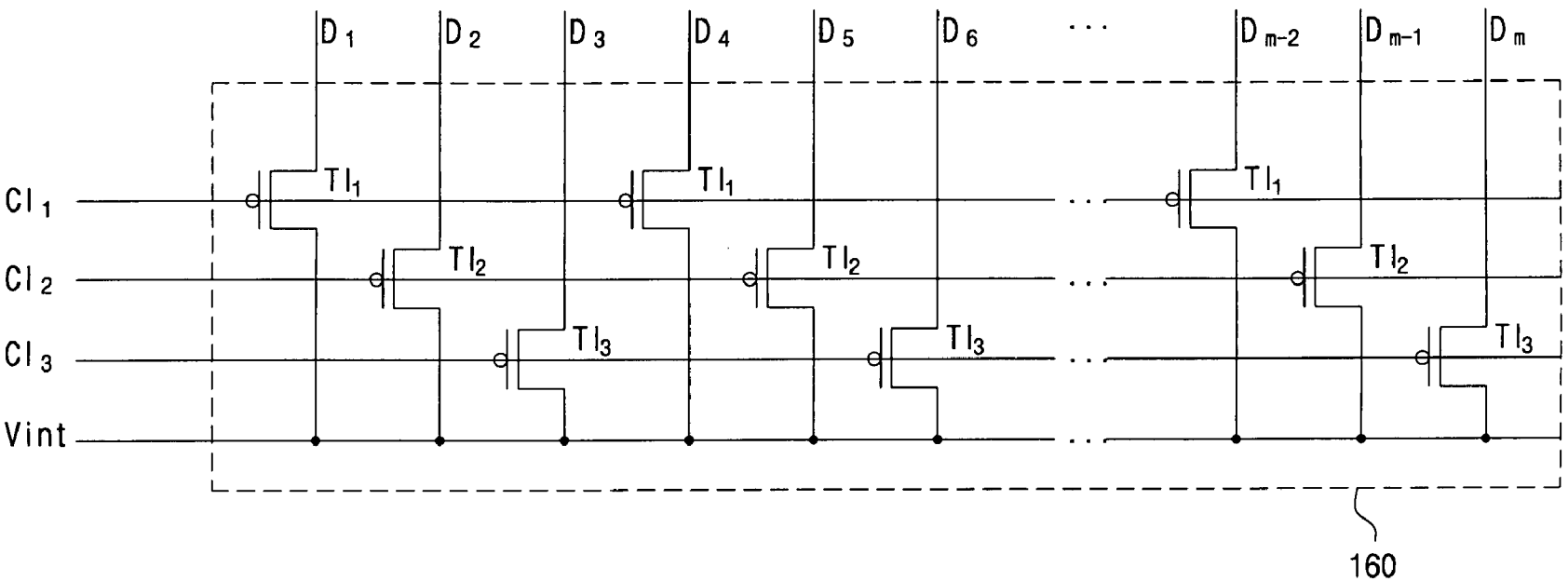
FIG. 5 is a circuit diagram of another example of a demultiplexer of the flat panel display according to the first exemplary embodiment of the present invention.

Alternatively, the lighting tester 160, as illustrated in FIG. 5, includes a first initialization transistor $TI_1$ controlled by a first control signal supplied through a first initialization control interconnection $CI_1$, a second initialization transistor $TI_2$ controlled by a second control signal supplied through the second initialization control interconnection $CI_2$ and a third initialization transistor $TI_3$ controlled by a third control signal supplied through a third initialization control interconnection $Cl_3$, the transistors disposed between the plurality of data lines $D_1$ to $D_m$ and the initialization interconnection $V_{int}$.

Figure 4:
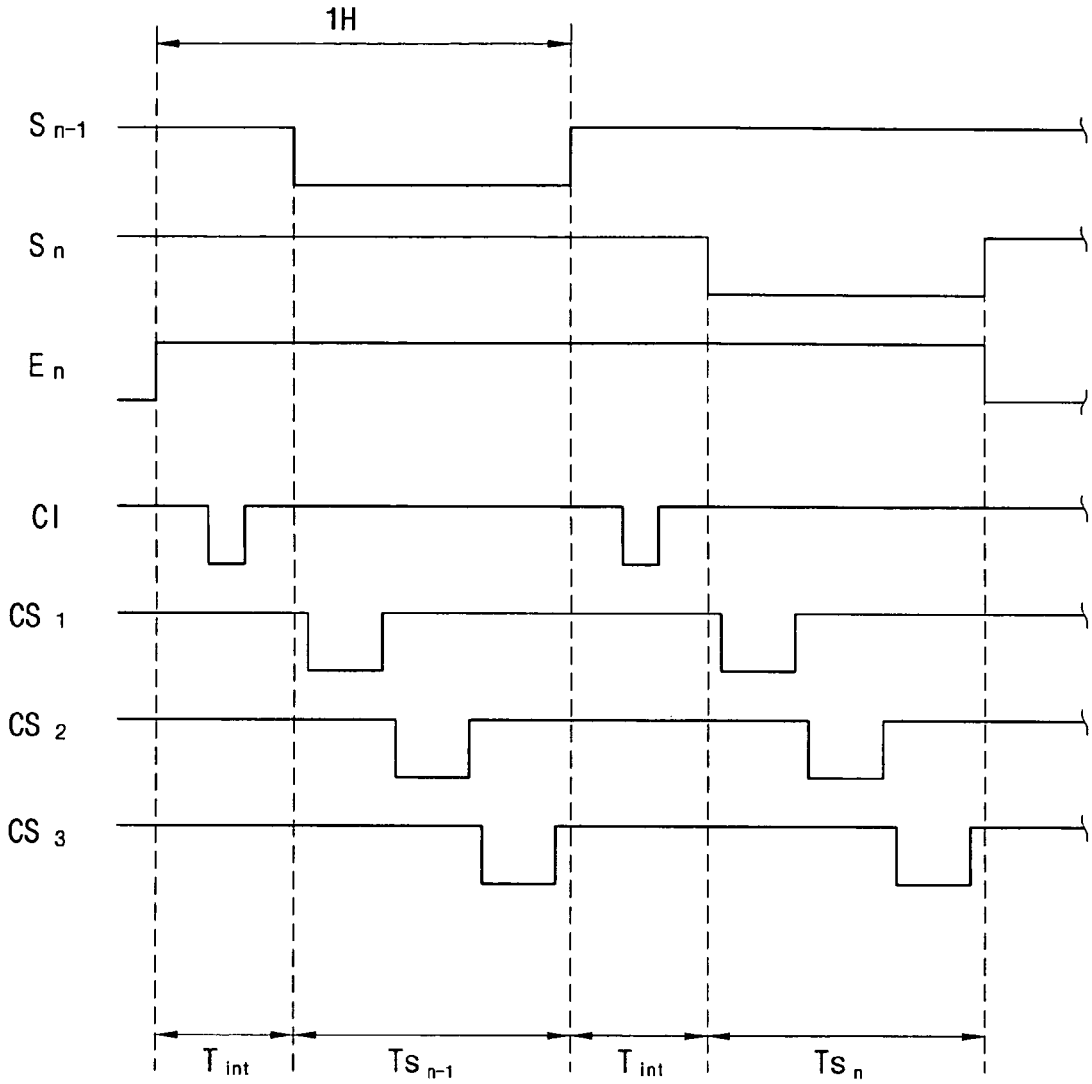
FIG. 4 is a timing diagram of signals supplied to the flat panel display according to the first exemplary embodiment of the present invention.

FIG. 4 is a timing diagram of signals supplied to the flat panel display according to the first exemplary embodiment of the present invention.

Referring to FIG. 4, a method of driving the flat panel display according to the first exemplary embodiment of the present invention includes dividing one horizontal period 1H into an initialization duration $T_{int}$ when a low-level initialization control signal is supplied through the initialization control interconnection CI and a current scan duration $T_{Sn}$ when current scan signals are supplied through a plurality of scan lines $S_1$ to $S_n$.

During the initialization duration $T_{int}$, the initialization transistor TI is turned on in response to the low-level initialization control signal, thereby electrically connecting the plurality of data lines $D_1$ to $D_m$ to the initialization interconnection $V_{int}$. Accordingly, the initialization signals are supplied to the plurality of data lines $D_1$ to $D_m$, and data signals which were supplied to the plurality of data lines $D_1$ to $D_m$ during a previous scan duration $T_{Sn-1}$ are initialized.

Subsequently, during the current scan duration $T_{Sn}$ when the current scan signal is supplied, data signals are sequentially supplied to the plurality of data lines $D_1$ to $D_m$ in response to first to third control signals supplied to the demultiplexer portion 140 through first to third control interconnections $CS_1$, $CS_2$ and $CS_3$ of the demultiplexer controller 145.

Figure 6:
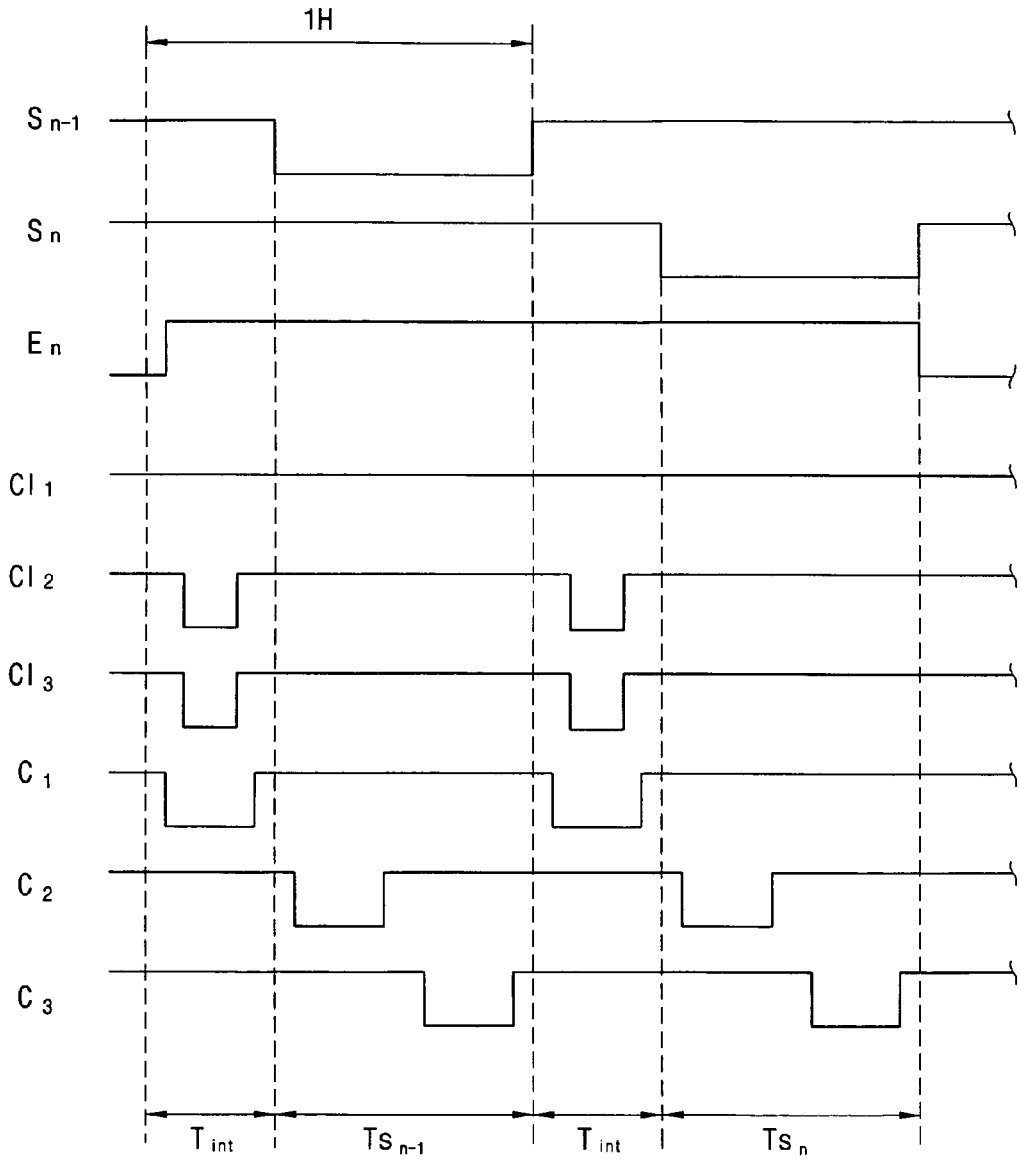
FIG. 6 is a timing diagram of signals supplied to the flat panel display including the demultiplexer illustrated in FIG. 5.

The lighting tester 160 according to the first exemplary embodiment of the present invention having the same structure as in FIG. 5, as illustrated in FIG. 6, controls the initialization signals and the data signals supplied to the plurality of data lines $D_1$ to $D_m$, thereby dividing the data lines $D_1$ to $D_m$ into two groups. The lighting tester 160 supplies the initialization signals to one group of data lines $D_2$, $D_3$, D5, D6, . . . , $D_{m-1}$ and $D_m$ and the data signals to the other group of data lines $D_1$, $D_4$, . . . , and $D_{m-2}$ during the initialization duration $T_{int}$, and sequentially supplies the data signals to the group of data lines $D_2$, $D_3$, D5, D6, . . . , $D_{m-1}$ and $D_m$ to which the initialization signals were supplied during the initialization duration $T_{int}$ during the current scan duration $T_s$.

As a result, the flat panel display according to the first exemplary embodiment of the present invention divides the horizontal period into the initialization duration and the current scan duration, initializes the data signals supplied in the previous scan duration during the initialization duration, supplies the current scan signals during the current scan duration, and sequentially supplies the data signals to the plurality of data lines, such that scan signals are supplied for a sufficiently long time period to the respective pixels.

Figure 7:
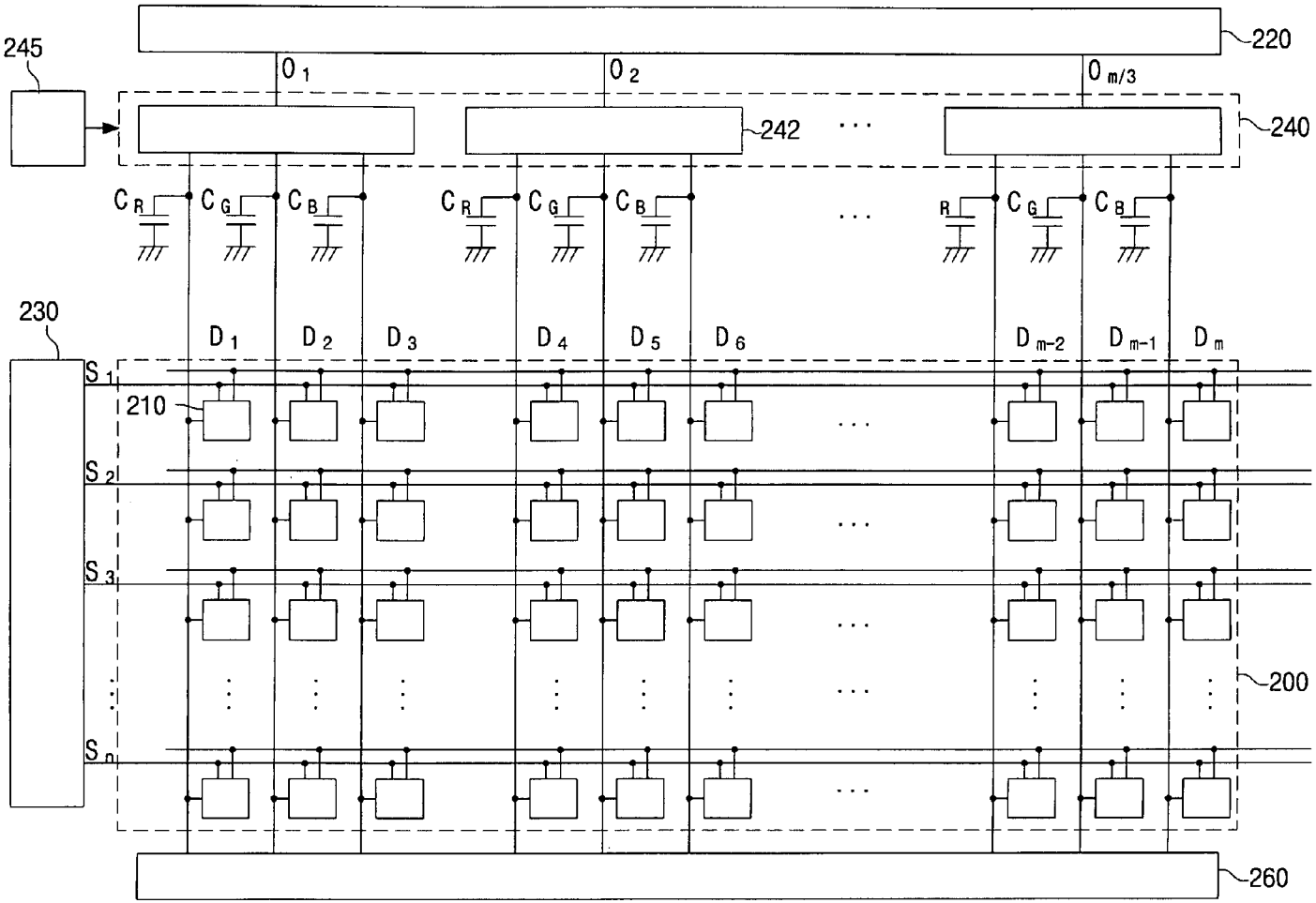
FIG. 7 is a schematic view of a flat panel display according to a second exemplary embodiment of the present invention.

FIG. 7 is a schematic view of a flat panel display according to a second exemplary embodiment of the present invention.

Referring to FIG. 7, the flat panel display according to the second exemplary embodiment of the present invention includes a pixel portion 200 having a plurality of pixels 210, a scan driver 230 for supplying scan signals to the pixel portion 200, a data driver 220 for outputting data signals through a plurality of output lines $O_1$ to $O_{m/3}$ and a demultiplexer portion 240 having at least one demultiplexer 242 sequentially supplying initialization signals and data signals through a plurality of data lines $D_1$ to $D_m$.

The data driver 220 converts digital image signals received from a timing controller (not illustrated) into data signals and supplies the data signals to the demultiplexer portion 240. The demultiplexer 242 of the demultiplexer portion 240 sequentially supplies the data signals to the pixel portion 200 through the plurality of data lines $D_1$ to $D_m$ electrically connected therewith in response to control signals of a demultiplexer controller 245, and supplies initialization signals to data lines $D_1$ to $D_m$ no supplied with the data signals.

Figure 8:
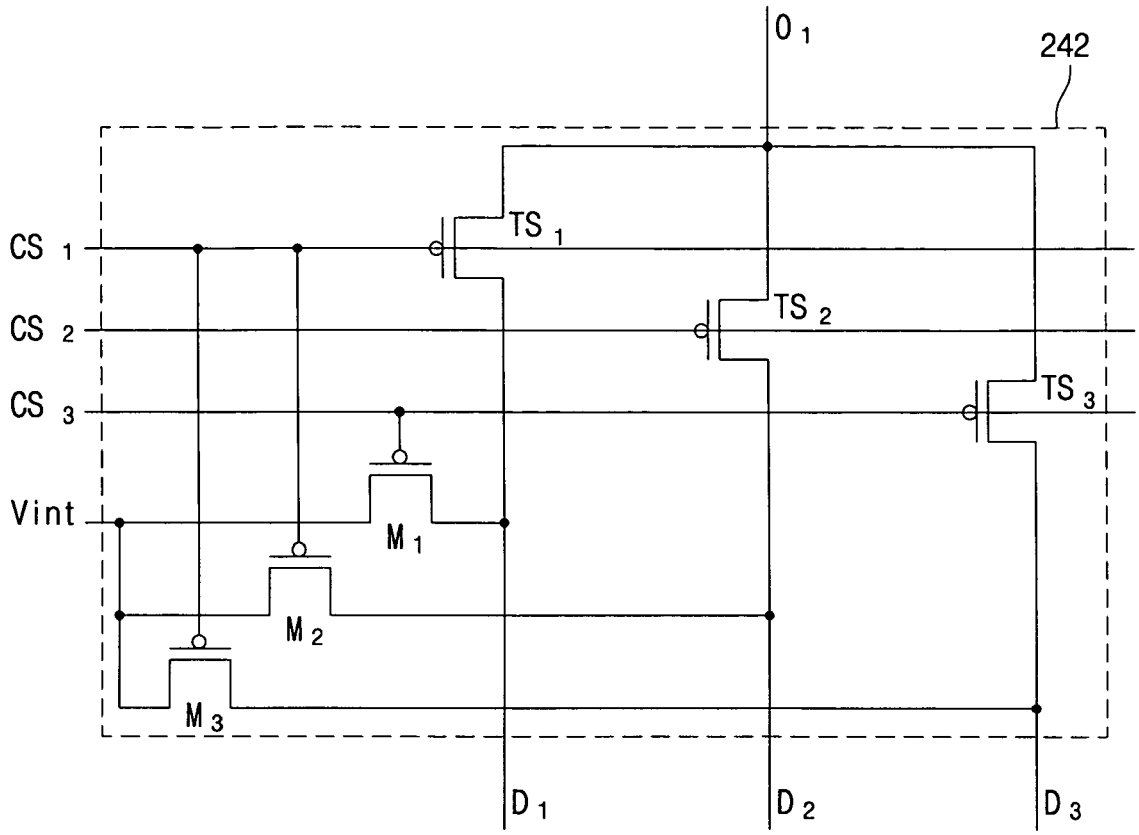
FIG. 8 is a circuit diagram of a demultiplexer of the flat panel display according to the second exemplary embodiment of the present invention.

FIG. 8 is a circuit diagram of the demultiplexer electrically connected to a first output line of the data driver in the demultiplexer portion of the flat panel display according to the second exemplary embodiment of the present invention.

Referring to FIG. 8, the demultiplexer 242 includes a first switching transistor $TS_1$ disposed between a first data line $D_1$ and an output line $O_1$ of the data driver, a second switching transistor $TS_2$ disposed between a second data line $D_2$ and the output line $O_1$ of the data driver, a third switching transistor $TS_3$ disposed between a third data lines $D_3$ and the output line $O_1$ of the data driver, a first initialization transistor $M_1$ disposed between an initialization interconnection $V_{int}$ and the first data line $D_1$, a second initialization transistor $M_2$ disposed between the initialization interconnection $V_{int}$ and the second data line $D_2$ and a third initialization transistor $M_3$ disposed between the initialization interconnection $V_{int}$ and the third data line $D_3$.

The second and third initialization transistors $M_2$ and $M_3$ are controlled by a first initialization control interconnection $CS_1$ supplying a first control signal to control the first switching transistor $TS_1$, and the first initialization transistor $M_1$ is controlled by a third initialization control interconnection $CS_3$ supplying a second control signal to control the third switching transistor $TS_3$.

While the second and third initialization transistors $M_2$ and $M_3$ are controlled by the first control signal to control the first switching transistor $TS_1$, and the first initialization transistor $M_1$ is controlled by the third control signal to control the third switching transistor $TS_3$ in the second exemplary embodiment of the present invention, in alternative embodiments, the second and third initialization transistors $M_2$ and $M_3$ may be controlled by the third control signal to control the third switching transistor $TS_3$, and the first initialization transistor $M_1$ may be controlled by the first control signal to control the first switching transistor $TS_1$.

Figure 9:
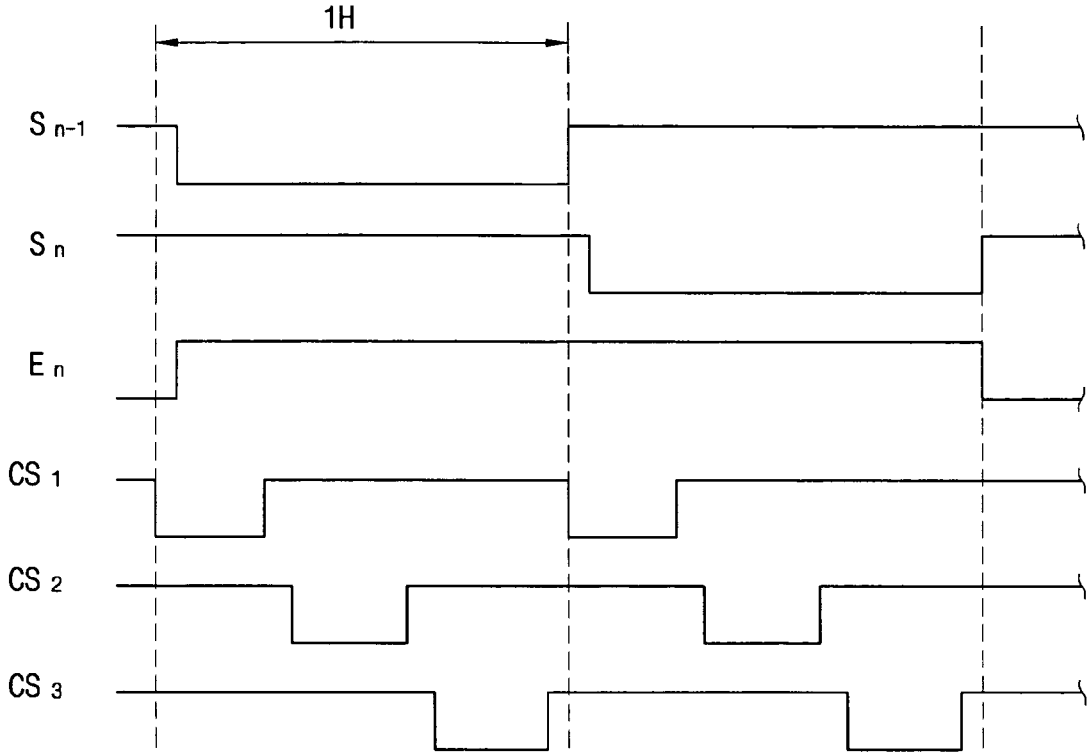
FIG. 9 is a timing diagram of signals supplied to the flat panel display according to the second exemplary embodiment of the present invention.

FIG. 9 is a timing diagram of signals supplied to the flat panel display according to the second exemplary embodiment of the present invention.

Referring to FIG. 9, a method of driving the flat panel display according to the second exemplary embodiment of the present invention includes supplying a current scan signal during one horizontal period 1H, and then sequentially supplying the first to third control signals to the demultiplexer 242 from the demultiplexer controller 245 while the current scan signals are supplied.

As described above, the first control signal supplied to the demultiplexer 242 turns on the first switching transistor $TS_1$, the second initialization transistor $M_2$ and the third initialization transistor $M_3$, so that a data signal is supplied to the first data line $D_1$, and initialization signals are supplied to the second and third data lines $D_2$ and $D_3$.

Furthermore, the second control signal supplied to the demultiplexer 242 turns on the second switching transistor $TS_2$, so that a data signal is supplied to the second data line $D_2$, and the third control signal of the demultiplexer 242 turns on the third switching transistor $TS_3$ and the first initialization transistor $M_1$, so that a data signal is supplied to the third data line $D_3$, and an initialization signal is supplied to the first data line $D_1$.

As a result, the flat panel display according to the second exemplary embodiment of the present invention supplies scan signals during the horizontal period, sequentially electrically connects the data lines electrically connected to the pixel portion and the data driver in response to the control signals of the demultiplexer, and electrically connects at least one of the plurality of data lines not connected to the data driver to the initialization interconnections to which the initialization signals were supplied, such that the scan signals are sufficiently supplied to the respective pixels.

Consequently, in a flat panel display and a method of driving the flat panel display according to the present invention, an initialization signal is supplied to a data line which is not electrically connected to a data driver before or while a scan signal is supplied to each pixel, and a data signal is supplied to the pixel while the scan signal is supplied, such that distortion or deformation of the data signal supplied to the pixel is prevented, and a duration of the scan signal is sufficiently long to compensate for a threshold voltage of a drive transistor.

Although exemplary embodiments of the present invention have been shown and described, it would be appreciated by those skilled in the art that modifications may be made to these embodiments without departing from the principles and spirit of the present invention, the scope of which is defined by the following claims.

What is claimed is:

1. A flat panel display, comprising:

a pixel portion having a plurality of pixels;

a scan driver supplying a plurality of scan signals to the pixel portion;

a data driver outputting a plurality of data signals to be supplied to the pixel portion;

a demultiplexer portion to sequentially supply initialization signals and the data signals to the pixel portion, the demultiplexer portion comprising a plurality of demultiplexers receiving corresponding ones of the data signals, each demultiplexer comprising:

a data input receiving one of the data signals;

an initialization signal input receiving an initialization signal;

first, second and third control signal inputs respectively receiving first, second and third control signals;

first, second and third switching transistors connected to the data input, the first switching transistor being operatively controlled by the first control signal, the second switching transistor being operatively controlled by the second control signal and the third switching transistor being operatively controlled by the third control signal;

first, second and third initialization transistors connected to the initialization signal input, the first initialization transistor being operatively controlled by the third control signal, the second initialization transistor being operatively controlled by the first control signal and the third switching transistor being operatively controlled by the first control signal; and first, second and third data lines sequentially supply the initialization signals and the data signals to the pixel portion.

2. The flat panel display as set forth in claim 1, further comprising:

the first data line being commonly connected to the first switching transistor and the first initialization transistor;

the second data line being commonly connected to the second switching transistor and the second initialization transistor; and the third data line being commonly connected to the third switching transistor and the third initialization transistor.

3. The flat panel display as set forth in claim 2, further comprising first, second and third data storage capacitors respectively connected to the first, second and third data lines.

4. The flat panel display as set forth in claim 1, further comprising a lighting tester supplying a lighting test signal to each data line when testing the pixel portion.

5. The flat panel display as set forth in claim 1, further comprising first, second and third data storage capacitors respectively connected to the first, second and third data lines.

6. A method of driving a flat panel display having a pixel portion having a plurality of pixels, a scan driver supplying a plurality of scan signals to the pixel portion, a data driver outputting a plurality of data signals to be supplied to the pixel portion and a demultiplexer portion sequentially supplying initialization signals and the data signals to the pixel portion, the demultiplexer portion including a plurality of demultiplexers receiving corresponding ones of the data signals, the method comprising:

supplying respective ones of the data signals to respective data inputs of each demultiplexer;

supplying an initialization signal to an initialization signal input of each demultiplexer;

supplying first, second and third control signals to respective first, second and third control signal inputs of each demultiplexer;

turning on or off first, second and third switching transistors connected to each of the data inputs of each demultiplexer, the first switching transistor being operatively controlled by the first control signal, the second switching transistor being operatively controlled by the second control signal and the third switching transistor being operatively controlled by the third control signal;

turning on or off first, second and third initialization transistors connected to the initialization signal input of each demultiplexer, the first initialization transistor being operatively controlled by the third control signal, the second initialization transistor being operatively controlled by the first control signal and the third switching transistor being operatively controlled by the first control signal; and supplying, sequentially, the initialization signals and the data signals to the pixel portion via first, second and third data line outputs from each demultiplexer.

7. The method as set forth in claim 6, further comprising:

commonly connecting the first data line to the first switching transistor and the first initialization transistor;

commonly connecting the second data line to the second switching transistor and the second initialization transistor; and commonly connecting the third data line to the third switching transistor and the third initialization transistor.

8. The method as set forth in claim 7, further comprising storing voltages corresponding to data signals into first, second and third data storage capacitors respectively connected to the first, second and third data lines.

9. The method as set forth in claim 6, further comprising supplying a lighting test signal to each data line when testing the pixel portion.

10. The method as set forth in claim 6, further comprising storing voltages corresponding to data signals into first, second and third data storage capacitors respectively connected to the first, second and third data lines.

* * * * *